United States Patent [19]

Klein et al.

[11] 3,937,045

[45] Feb. 10, 1976

[54] DYEING AND PRINTING OF MATERIALS

[75] Inventors: Norman E. Klein, Inman; William H. Stewart, Jr., Spartanburg, both of S.C.

[73] Assignee: Deering Milliken Research Corporation, Spartanburg, S.C.

[22] Filed: Jan. 3, 1974

[21] Appl. No.: 430,524

[52] U.S. Cl. ..... 68/205 R; 55/462; 68/183

[51] Int. Cl.[2] ..... D06B 1/02

[58] Field of Search ..... 68/205 R, 183, 18 R; 346/75; 55/462

[56] References Cited

UNITED STATES PATENTS

| | | | |
|---|---|---|---|
| 2,346,435 | 4/1944 | Johnson | 55/462 |
| 3,443,878 | 5/1969 | Weber et al. | 68/183 X |
| 3,570,275 | 3/1971 | Weber et al. | 68/183 X |

FOREIGN PATENTS OR APPLICATIONS

| | | |
|---|---|---|
| 91,797 | 8/1972 | Germany |

*Primary Examiner*—Harvey C. Hornsby
*Assistant Examiner*—Philip R. Coe
*Attorney, Agent, or Firm*—Luke J. Wilburn, Jr.; H. William Petry

[57] ABSTRACT

Apparatus to collect and separate dye from a dye mist so that the dye may be recirculated to the dye system and the air system will become uncontaminated with dye particles.

6 Claims, 7 Drawing Figures

DYEING AND PRINTING OF MATERIALS

This invention relates to the application of dyestuffs to textile materials and, more particularly, to the printing of textile fabrics having relatively porous surfaces, such as pile carpets.

Textile fibers and fabric materials have long been colored with natural and synthetic dyes, and, in particular, printed by color decoration of the surface or surfaces of the materials in definite repeated forms and colors to form a pattern. The color printing of textile fabrics has been accomplished in various ways. Earlier forms of printing used carved blocks charged with colored paste pressed against the fabric. Subsequently, speed of printing has been increased by the development of roller printing wherein moving fabrics are sequentially contacted by engraved metal rollers each containing a different color dye to form the desired pattern thereon. Textile fabrics are also printed by sequential contact with screens each having a porous portion of a pattern and carrying a particular color dyestuff.

More recently, it has been proposed to print textile fabrics, including pile carpets, by the programmed spraying or jetting of plural colored dyes onto the surface of a moving fabric. Typical of such processes and apparatus are described in U.S. Pat. No. 3,443,878; U.S. Pat. No. 3,570,275 and British Pat. No. 978,452. Generally, such apparatus consists of a plurality of dye applicator bars spaced along the direction of movement of the textile material and each containing multiple dye nozzles or jets extending transversely across the moving material. Each jet may be activated by suitable electric, pneumatic, or mechanical means to dispense dyes onto the moving material in a desired sequence, and pattern control of the jets may be accomplished by suitable programming means, such as coded punch tapes, magnetic tapes, computers, and the like.

U.S. Pat. Nos. 3,443,878 and 3,570,275 disclose specific means for applying streams of dyes to print a fabric by use of continuously flowing streams of dyes which are deflected by a stream of air to either impinge the dyestream upon the fabric or recirculate it to a reservoir. Control of such systems to form printed patterns may be accomplished by various of the aforementioned programming and control means.

In order to provide a greater variety of colors or shades of colors to the fabrics by use of such spray printing apparatus, it has also been proposed to apply different colors to the same locations or areas of the fabric to thereby blend primary colors in situ.

It can be appreciated that in the application of different colored dyes to the surface of textile fabrics, it is extremely important to accurately place each dyestuff on the fabric, particularly when intricate patterns are being printed and when in situ blending is employed. In dyeing relatively porous textile fabrics, such as pile carpets, it is also important that a carefully controlled amount of dye be applied to each dyed area on the pile surface to ensure optimum penetration of the dye color to the depth of the pile fiber without undesirable spread of the color into adjacent area of the fabric. U.S. Pat. No. 3,393,411 discusses such a problem of dye penetration of pile carpet and suggests controlling the flow rate of the dyestuff and the speed of movement of the pile carpet past the dye application point to provide the desired amount of dye to the carpet.

In printing pile carpets with detailed patterns of colors, it can be appreciated that the dye jet applicators are very closely spaced relative to each other to permit dyeing in fine detail on the pile surface. The mounting, construction or programmed control of various gun bars for application of various dyestuffs to moving webs are also disclosed in one or more of British Pat. Nos. 1,201,598; 1,201,600; 1,201,599; and 1,202,345.

The present invention deals with improvements in the jet printing of textile products including pile fabrics and, in particular, in the accurate placement of increments of dye at specific locations on and/or in the surface of the pile fabrics to improve the pattern definition in such fabrics.

Therefore it is an object of the invention to provide a novel dyeing system which separates the dye from an air stream and allows the dye to be recirculated for re-use in the printing system.

The present invention will be better understood by reference to the accompanying drawings which disclose a specific embodiment of the invention, and wherein.

Figure 1:
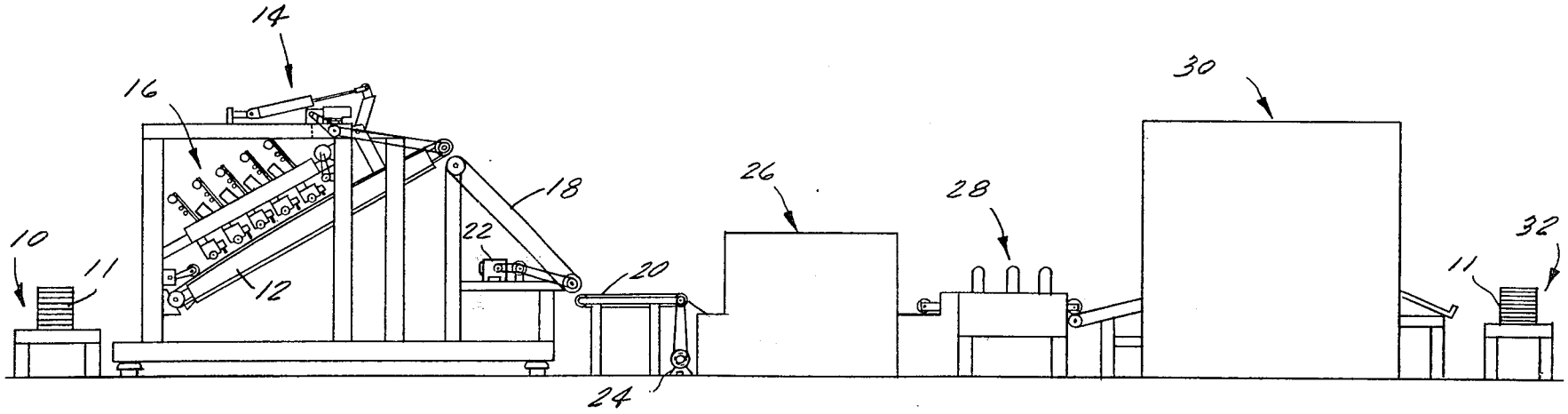
FIG. 1 is a schematic side elevation of apparatus for the jet dyeing of textile materials.

Referring more specifically to the drawing, FIG. 1 shows a jet dyeing apparatus for color printing textile fabrics such as pile carpets, tiles, and the like. As seen, the apparatus consists of a tile supply table 10 where a plurality of tiles 11 is fed manually, or by suitable automatic mechanical means, not shown, onto the lower end of an inclined conveyor 12 of a jet dye applicator 14 where the tiles are suitably printed by the programmed operation of a plurality of jet gun bars 16 in a manner which will be explained. The printed tiles leaving the dye applicator are moved by conveyors 18, 20 and driven by motors 22, 24, respectively, to a steam chamber 26 where the dyestuffs are fixed on the textile material. The tiles leaving steam chamber 26 are conveyed through a washer 28 and dryer 30 to a collection table 32 where they are accumulated either manually or by suitable automatic means, not shown, for subsequent use.

Figure 2:
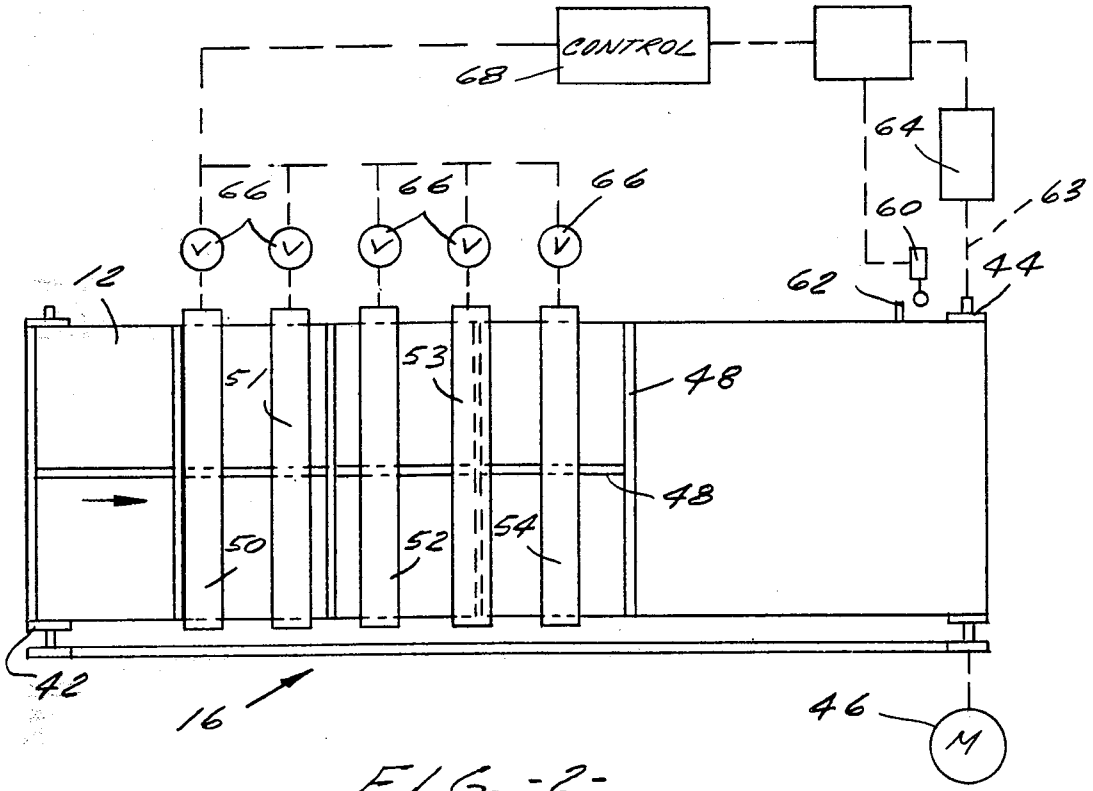
FIG. 2 is an enlarged schematic plan view of the jet dye application portion of the apparatus of FIG. 1, showing in more detail the cooperative relation and operation of the conveyor with the jet gun bars.

Details of the present invention are best shown by reference to FIG. 2 which is an enlarged schematic plan view of the jet dye applicator 14 of FIG. 1 and shows the endless conveyor 12 which is suitably supported for movement about rotatable rollers 42, 44 and driven by motor means 46. When it is desired to print carpet tiles of rectangular or square shape, the conveyor 12 is provided with a series of separator bars or spaces 48 which accurately position the tiles in spaced relation to each other on the conveyor. During movement of the conveyor, the tiles pass sequentially adjacent and beneath gun bars 16, five of which, 50–54, are shown schematically spaced along the path of travel of the conveyor and extending across its full width. Each jet gun bar is made up of a plurality of individual jet orifices which supply dyes in narrow streams to the surface of the pile carpet tiles. The stream of dyes issuing from each orifice of the gun bar is controlled individually by suitable means, which will be explained.

Each gun bar includes a dye supply manifold connected to the jet orifices of the bar which is supplied with liquid dyestuff from a reservoir so that each bar may be provided with a different color dye for printing the tiles. Typically, each gun bar may be provided with a primary color and operation of the individual jets of the gun bar are programmed to produce a desired pattern, with blending of the primary colors in situ on the surface of the carpet to provide many different shades and colors.

To ensure that the streams of dyestuff strike the carpet tile at an exact location to form the pattern in the carpet tile, control means are provided for coordination of the firing of each particular dye jet of the gun bars at the right time to the movement of the conveyor transporting the tiles for printing. As broadly shown in FIG. 2, the control system is provided with a synchronization switch 60 which is activated by a mechanical trip finger 62 attached to the edge of the conveyor 12 to engage the switch 60 at a given position of conveyor movement.

Operatively connected to the shaft 63 of roller 44 by suitable means, not shown, is a transducer 64 which converts the mechanical movement of conveyor 12 to a plurality of electrical pulses which activate firing of particular jets on the gun bars at desired positions of the conveyor, by controlling the pneumatic valves 66 through a suitable control 68.

Figure 3:
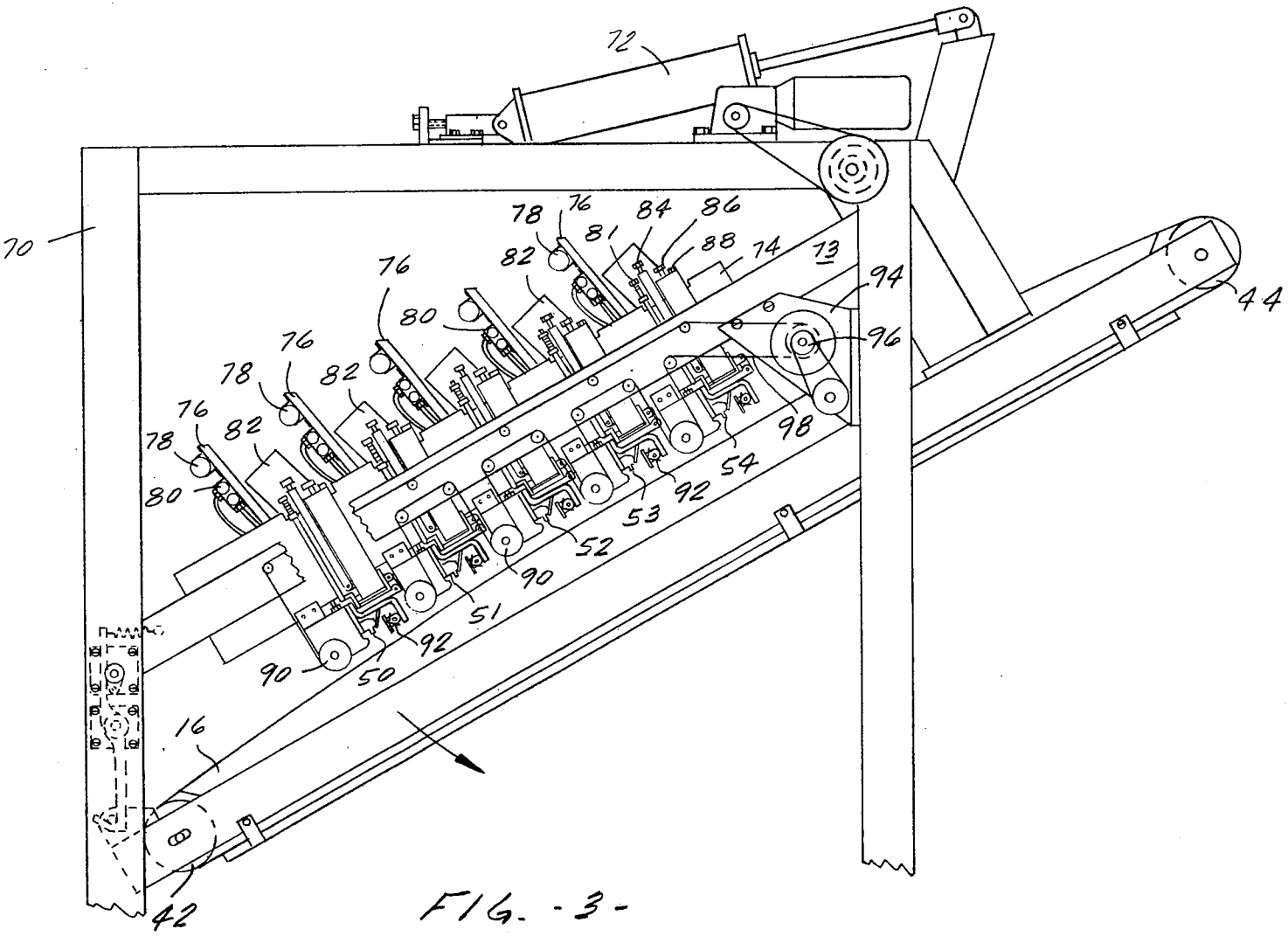
FIG. 3 is a blown-up view of the jet dye applicator shown.

Looking now to FIG. 3, the jet dye applicator 14 is shown enlarged to more clearly illustrate the relationship of the individual elements. The conveyor 12 of the jet dye applicator 14 is pivotally mounted in a frame 70 on top of which is mounted a piston 72 to pivot the conveyor 12 from the position shown in solid lines to a position away from the jet dye guns 50–54 so that access can be readily made to the jet dye guns 50–54 and associated apparatus.

The jet dye apparatus basically is supported by two spaced apart plate members 74 which in turn are attached to frame members 73. Mounted on frame members 73 is an upstanding support member 76 on which is mounted an air manifold 78, a dye header pipe 80 and a box 82 to support a plurality of valve cards with electrically operated pneumatic valves mounted thereon. Projecting upwardly from the support member 74 is a plurality of screw members 81, 84, 86 and 88 for adjustment of the jet dye applicator gun bars.

Shown schematically at the bottom of the support member 74 at each position of the jet dye gun bars is an auger member 90 to recirculate dye liquid back to the dye reservoir and a jet washer 92 to wash out the dye openings of the dye jet guns. Mounted on one of the vertical frame members through a suitable support 94 is a driven pulley 96 which drives the auger member 90 through a suitable drive belt 98 and idler pulleys (not shown).

Figure 4:
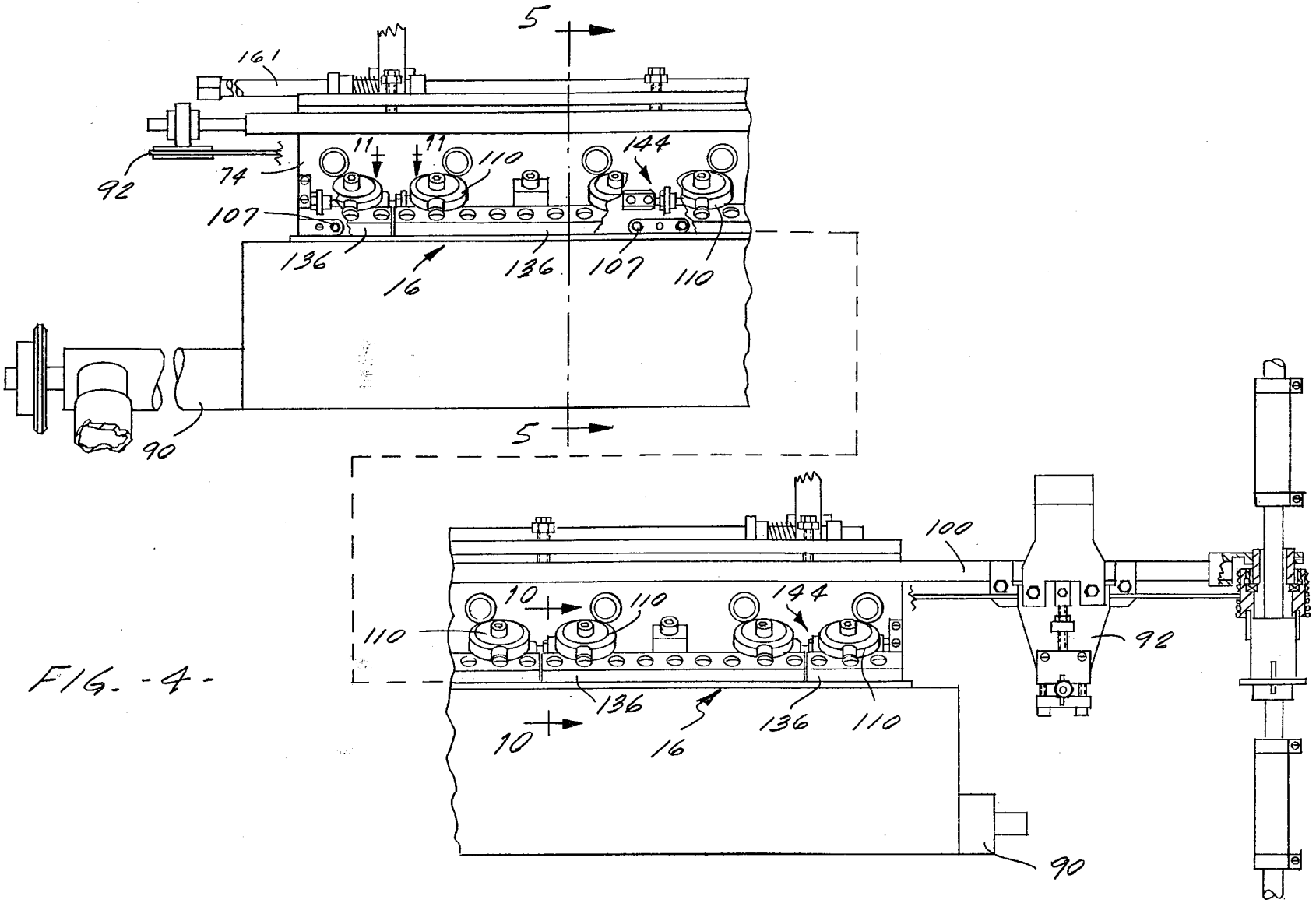
FIG. 4 is a partially schematic front view of one row of the jet dye applicator unit.
Figure 5:
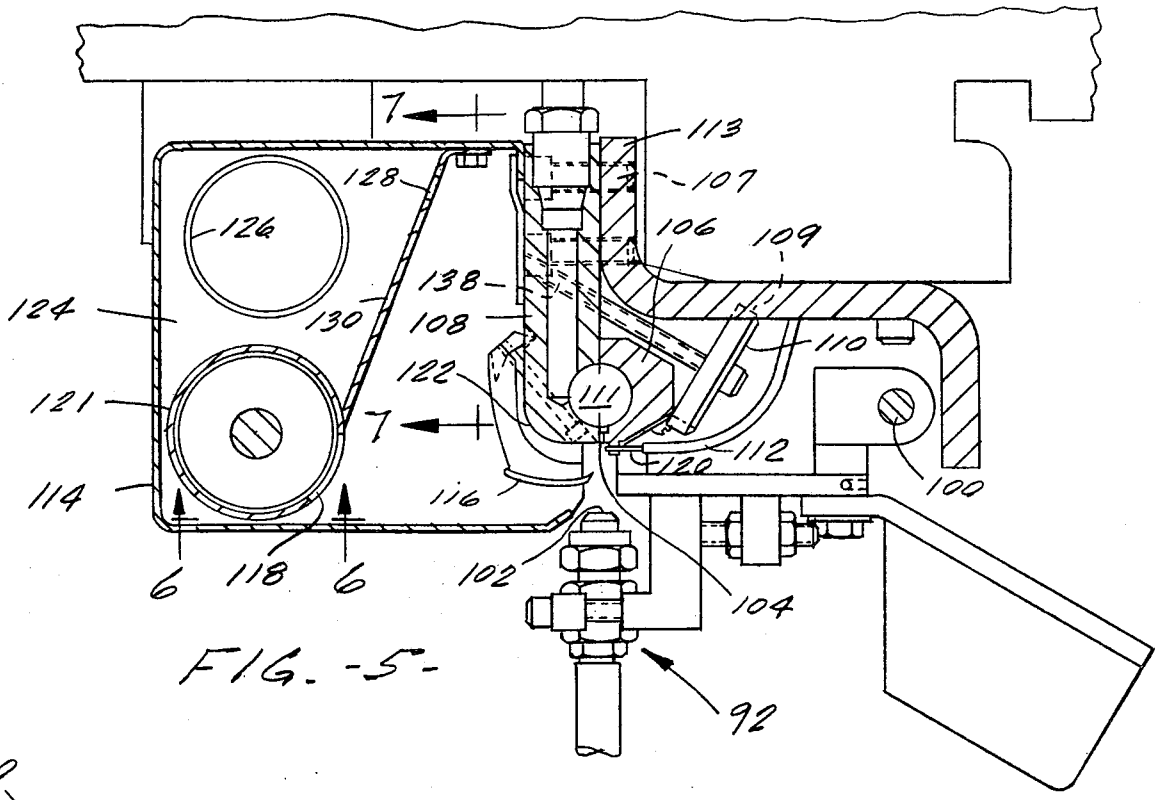
FIG. 5 is a cross-sectional view taken on line 5—5 of FIG. 4.
Figure 6:
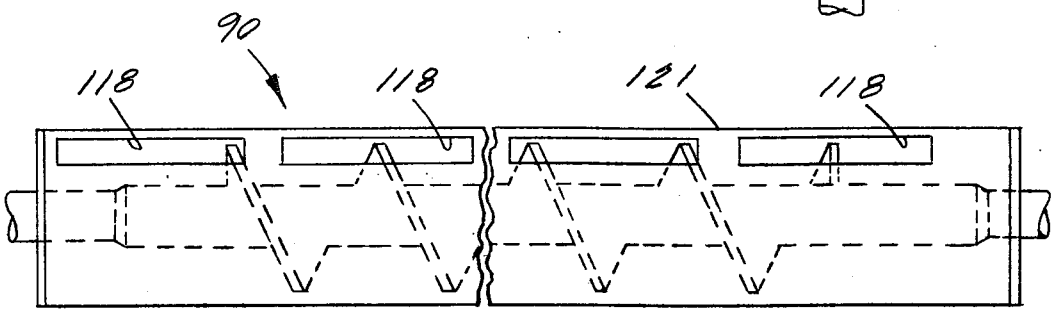
FIG. 6 is a view taken on line 6—6 of FIG. 5 showing the dye auger unit.
Figure 7:
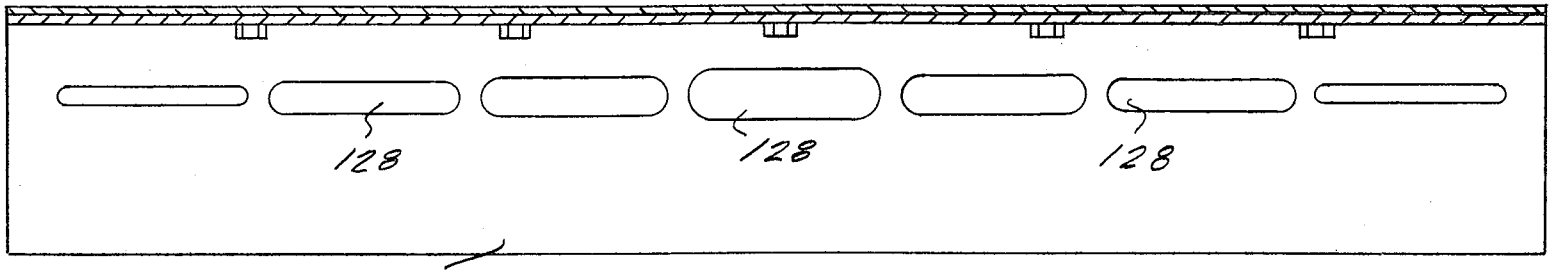
FIG. 7 is a top view of the air and dye deflection plate taken on line 7—7 of FIG. 5.

As shown broadly in FIG. 3 and in more detail in FIGS. 4 and 5 the dye jet orifice washer 92 is slidably mounted on a bar 100 mounted across each of the gun bars so the washer 92 is so aligned with each of the gun bars that the pressure water orifice 102 is directly in line with the orifices 104 of the gun bar in order to squirt a jet of water therein to counteract dye liquor jet action and backwash and dislodge any particles or foreign matter.

FIG. 5, which is a cross-sectional view through one of the dye jet structures of FIG. 4, shows wherein the gun bars 16 consist of a Z shaped member 113 attached to second portion 108 by screws 107 and which in turn is supported to first portion 106 being locked thereto by suitable screw washer assembly 110 which engage a notch 109 in the Z bar support member 113 and the top of the first portion 106. Z shaped member 113 and second portion 108 provide an accurate plane surface which coacts with the upper portion 106 when clamped securely thereto to provide a non-leak construction. As described previously dye from cavity 111 is supplied continuously from jet 104 and the pattern in the fabric being dyed is controlled by cutting off or cutting on the air pressure to selected air lines 112 to divert the dye liquid into the collection and separation chamber 114. Extending across the chamber 114 is a deflector or cut off 116 which tends to direct dye in the air stream toward the openings 118 in the cylinder 121 around the auger member 90. The dye in the air stream from the air nozzle 120 connected to the air line 112 separates from the air stream partially due to the Coanda effect of the air foil shape 122 of the bottom of the second portion 108 of the gun bar and to the suction pressure applied to the chamber 124 by suction line 126 to pull the air through the openings 128 in the plate 130. The air foil shape 122 of the bottom of the second portion 108 and the deflector 116 together form a nozzle therebetween to provide a venturi effect which acts to pull air into the collection and separation chamber.

The unused dye that falls into the catch basin or chamber 114 is delivered to the auger member 90 through openings 118 in the cylinder 121 and is positively delivered back to the dye containers 80 by the screw action of the auger member 90.

The herein disclosed apparatus provides a novel apparatus to jet dye a fabric which employs a unique system to collect and separate dye liquor which has been sprayed from the dye jet.

Although the preferred form of the invention has been specifically described herein, it is contemplated that many changes may be made without departing from the scope or spirit of the invention, and it is desired that the invention be limited only by the scope of the claims.

That which is claimed:

1. Apparatus for applying dyestuff to a moving material to dye the same including means for conveying the material in a predetermined path of travel, a dye jet gun bar having a row of dye-emitting orifices extending across the path of travel, means for supplying dye to the gun bar and orifices to direct the dye in plural streams toward the moving material to be dyed, gaseous fluid discharge means having a row of gaseous fluid discharge orifices positioned on one side of said row of dye-emitting orifices with the discharge axis of each of said gaseous fluid discharge orifices intersecting the discharge axis of a respective dye-emitting orifice for selectively directing streams of gaseous fluid against the streams of dye to deflect the same away from the path of travel of the material, and dye collection and separation means including a dye collection and separation chamber having an elongate opening extending along the gun bar on the opposite side of the dye-emitting orifices from said gaseous fluid discharge orifices for receiving the deflected dye and gaseous fluid therein, said collection and separation means including an elongate wall defining one side of said opening, said wall having a curved surface extending from approximately tangent to the discharge axes of said gaseous fluid discharge orifices adjacent said opening and diverging progressively inwardly of said chamber from said opening and away from said axes of the gaseous fluid discharge orifices to facilitate separation of gaseous fluid from liquid dye being deflected into the said chamber.

2. Apparatus to apply liquid dyestuff to moving material comprising a dye jet gun bar having a plurality of dye-emitting orifices, means to convey the material adjacent said orifices, means to supply liquid dyestuff to said gun bar and orifices to direct the dye in plural streams toward the moving material to be dyed, means to supply a gaseous fluid under pressure against the dye streams issuing from said orifices to divert the streams in a path of collection away from said means to convey, a dye accumulation chamber having an entrance positioned adjacent said orifices and in said collection path to collect the diverted dye, a wall adjacent said entrance and said path having a curved surface diverging from said collection path to facilitate separation of the gaseous fluid from the liquid dye due to a surface attachment effect, and a deflector plate located across the entance of said accumulation chamber from said curved wall surface and having a facing surface diverging from the curved wall surface inwardly of the entrance to create a venturi effect in the path of collection and facilitate movement of the dye into the accumulation chamber.

3. The apparatus of claim 1 wherein said chamber includes a deflector plate and a dyestuff accumulation area, said deflector plate diverting the separated dyestuff to said dyestuff accumulation area.

4. The apparatus of claim 3 wherein a screw type member is mounted in said dyestuff accumulation area to deliver the dyestuff back to the means to supply dyestuff to said gun bar.

5. The apparatus of claim 4 wherein said chamber includes a means to place said area under a negative pressure.

6. The apparatus of claim 3 wherein a dyestuff circulating member is mounted in said dyestuff accumulation area to deliver the dyestuff back to the means to supply dyestuff to said gun bar.

* * * * *